US006250071B1

(12) United States Patent
Schmoll, III

(10) Patent No.: US 6,250,071 B1
(45) Date of Patent: Jun. 26, 2001

(54) HOUSING FOR A DISK PROPULSION SYSTEM AND A METHOD OF USING THE SAME

(75) Inventor: George F. Schmoll, III, Gurnee, IL (US)

(73) Assignee: Schmoll & Halquiss, Grayslake, IL (US)

( * ) Notice: Subject to any disclaimer, the term of this patent is extended or adjusted under 35 U.S.C. 154(b) by 0 days.

(21) Appl. No.: 09/384,842

(22) Filed: Aug. 27, 1999

(51) Int. Cl.[7] ..... B63H 11/00

(52) U.S. Cl. ..... 60/204; 60/221; 415/90; 440/76

(58) Field of Search ..... 60/221, 204; 440/71, 440/72, 76, 77; 415/90

(56) References Cited

U.S. PATENT DOCUMENTS

| | | | |
|---|---|---|---|
| 149,802 | 4/1874 | Smith et al. . | |
| 156,102 | 10/1874 | Rodgers . | |
| 1,013,248 | 1/1912 | Wilkinson . | |
| 1,047,898 | 12/1912 | Scott . | |
| 1,056,338 | 3/1913 | Johnsen . | |
| 1,061,142 | 5/1913 | Tesla . | |
| 1,197,761 | 9/1916 | Pfau . | |
| 1,323,542 | 12/1919 | Naylor . | |
| 2,087,834 | 7/1937 | Brown et al. . | |
| 2,245,035 | 6/1941 | Hartman . | |
| 2,640,678 | 6/1953 | Andresen . | |
| 2,997,847 | 8/1961 | Hollingsworth . | |
| 3,045,428 | 7/1962 | McLean . | |
| 3,157,793 | 11/1964 | Adkins . | |
| 3,260,039 | 7/1966 | Brown et al. . | |
| 3,326,522 | 6/1967 | Pickering . | |
| 3,487,784 | 1/1970 | Rafferty et al. . | |
| 3,644,051 | 2/1972 | Shapiro . | |
| 3,692,422 | 9/1972 | Girardier . | |
| 3,746,467 | 7/1973 | Buse . | |
| 3,786,996 | 1/1974 | Richter . | |
| 3,864,055 | 2/1975 | Kletschka et al. . | |
| 4,025,225 | 5/1977 | Durant . | |
| 4,077,220 | 3/1978 | Matthews . | |
| 4,232,992 | 11/1980 | Possell . | |
| 4,347,032 | 8/1982 | Possell . | |
| 4,403,911 * | 9/1983 | Possell | 415/90 |
| 5,192,182 | 3/1993 | Possell . | |
| 5,501,622 * | 3/1996 | Phelan | 440/71 |

FOREIGN PATENT DOCUMENTS

| | | |
|---|---|---|
| 866706 | 5/1941 | (FR) . |
| 179048 | 5/1922 | (GB) . |

OTHER PUBLICATIONS

Griffin et al. "A Design Method for High–Speed Propulsor Blades," *Transactions of the ASME*, vol. 120, Sep. 1998, pp. 556–562.

* cited by examiner

*Primary Examiner*—Timothy S. Thorpe
*Assistant Examiner*—Ehud Gartenberg
(74) *Attorney, Agent, or Firm*—Patents+TMS

(57) ABSTRACT

A housing for a propulsion system, such as for a plurality of disks, is provided as well as a system and a method for using the same. The housing is shaped to provide a streamlined motion through a fluid, such as air or water. Openings in the housing allow the fluid to flow through the propulsion system. The housing may be attached to a shaft in a motor or engine to provide a drive for the propulsion system contained therein.

10 Claims, 1 Drawing Sheet

HOUSING FOR A DISK PROPULSION SYSTEM AND A METHOD OF USING THE SAME

BACKGROUND OF THE INVENTION

The present invention generally relates to a housing for a disk rotor propulsion turbine system. More specifically, the present invention relates to a housing for a disk rotor propulsion system having a generally wedge-shaped front end, an intake opening, and an outflow opening for use in a propulsion system as well as a method for using the same.

It is, of course, generally known to provide propulsion systems and housings that are designed to move a craft through a fluid medium. Moreover, it is generally known to provide pumps or engines that are designed for use with a plurality of disks stacked one atop another with minimal spacing therebetween. The disks, upon high speed rotation, provide an engine or motor with high power output using relatively low amounts of input energy.

Known disk rotor systems are generally used as pumps. The typical housing for a disk rotor system is generally cylindrically-shaped with an inflow opening along a longitudinal axis of the cylinder and an outflow tube that is perpendicular to the longitudinal axis of the cylinder. As the disks spin, centrifugal forces draw the material from the opening at the axis of the disks to a periphery of the disks. The outflow opening generally allows the material to be expelled from the housing. These pumps are generally stationary systems and are not designed or shaped to move through the material being pumped.

It is known, for example, in U.S. Pat. No. 4,768,920, to provide a housing having a generally cylindrical chamber formed by a pair of circular endwalls connected by a peripheral wall within which is mounted a disk rotor system. The housing includes an inlet into the chamber and an outlet from the periphery of the chamber. In operation, fluid, such as air or water, is introduced through the inlet port and directed into an axial opening of the system of disks. Rotation of the disks along with the viscosity of the fluid imparts a propulsive force thereto.

As fluid enters the disk system, fluid molecules attach to the disk surfaces to form a boundary layer. The boundary layer serves as a molecular buffer between the disk surface and the fluid contents. As the rotor is powered and the disks spin, the boundary layer attracts and drags along other layers of molecules through the centrifugal force. The dynamic force propels the fluid which is then expelled from the system of disks along the periphery of the disks through an output opening.

A need, therefore, exists for an improved housing for the disk rotor system to provide an efficient and low cost propulsion system capable of aerodynamic movement through a pumped medium.

SUMMARY OF THE INVENTION

The present invention generally relates to a housing for a propulsion system containing a plurality of disks for use with a fluid, such as air or water, as well as a method for using the same.

To this end, in an embodiment of the present invention, an apparatus is provided. The apparatus has a housing that has a first end, a second end, a first side and an interior compartment wherein the first end has a wedge shape. A first intake opening is provided in the first side of the housing. An outflow opening is provided at the second end of the housing.

In an embodiment, a second intake opening is provided in a second side of the housing.

In an embodiment, the second end has a planar face and is perpendicular to a longitudinal axis of the housing.

In an embodiment, the outflow opening is rectangularly shaped.

In an embodiment, the first intake opening is rectangularly shaped.

In an embodiment, the housing has a second side wherein the first side and second side form the wedge-shaped first end of the housing.

In an embodiment, the housing has a second side wherein the first and second sides form the wedge-shaped first end of the housing. The housing has a third and fourth side wherein the third and fourth sides are planar and parallel with respect to each other and perpendicular with respect to the first and second sides.

In an embodiment, the first intake opening directs a fluid into the interior compartment of the housing.

In an embodiment, the wedge-shaped first end provides for streamlined motion through a fluid.

In an embodiment, the outflow opening in the second end of the housing directs a fluid away from the interior compartment of the housing.

In another embodiment of the present invention, a system is provided. The system has a housing that has a first end, a second end, a first side and an interior compartment wherein the first end of the housing has a wedge shape. An interior compartment is contained within the housing. A first intake opening is provided in the first side of the housing. An outflow opening is provided at the second end of the housing. A propulsion system has a plurality of disks within the interior compartment of the housing.

In an embodiment, the intake opening is capable of directing a fluid directly into an axial opening of each of the plurality of disks.

In an embodiment, the system has a drive shaft on which each of the plurality of disks is rotatably attached.

In an embodiment, a motor is connected to the drive shaft capable of driving the propulsion system.

In another embodiment of the present invention, a method of using a disk propulsion system is provided. The method comprises the steps of: providing a housing having a first end, a second end, a first side and an interior compartment wherein the first end of the housing has a wedge-shape opening in the first side of the housing and further wherein the housing has an outflow opening in the second end of the housing; providing a propulsion system having a plurality of disks within the interior compartment of the housing.

In an embodiment, a motor is attached to the plurality of disks.

In an embodiment, the plurality of disks is rapidly rotated to provide a propulsive force to the housing in the fluid.

In an embodiment, a shaft is provided between the rotor and the housing.

In an embodiment, fluid is pulled through the intake opening and allowed to flow through the housing.

In an embodiment, a fluid is ejected from the housing through the outflow opening.

It is, therefore, an advantage of the present invention to provide an apparatus, a system and a method to provide a housing that moves through a fluid, such as air or water.

Another advantage of the present invention is to provide an apparatus, a system and a method to provide a propulsion system connected to a motor or an engine.

A further advantage of the present invention is to provide an apparatus, a system and a method to provide a plurality of disks as a propulsion system in order to provide greater efficiency than standard propulsion systems.

Yet another advantage of the present invention is to provide an apparatus, a system and a method to allow for streamlined movement through a fluid.

A still further advantage of the present invention is to provide an apparatus, a system and a method to provide a unique placement of openings to allow fluid to flow through the housing.

A still further advantage of the present invention is to provide an apparatus, a system and a method to provide a non-impingement type rotor system that minimizes damage to the rotor.

A further advantage of the present invention is to provide an apparatus, a system and a method to allow the rotor to operate without damage during cavitation, volume fluctuations, and during shut-off.

Yet another advantage of the present invention is to provide an apparatus, a system and a method to allow impurities in the fluid to pass through the rotor system without damaging the rotor system or creating inefficiencies within the system.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a housing for use in a device, such as a disk rotor propulsion system. Preferably, the propulsion system consists of a plurality of disks stacked one atop another and incorporated in the interior of the housing. The present invention further relates to a system that incorporates the housing of the present invention as well as a method of using the same.

Figure 1:
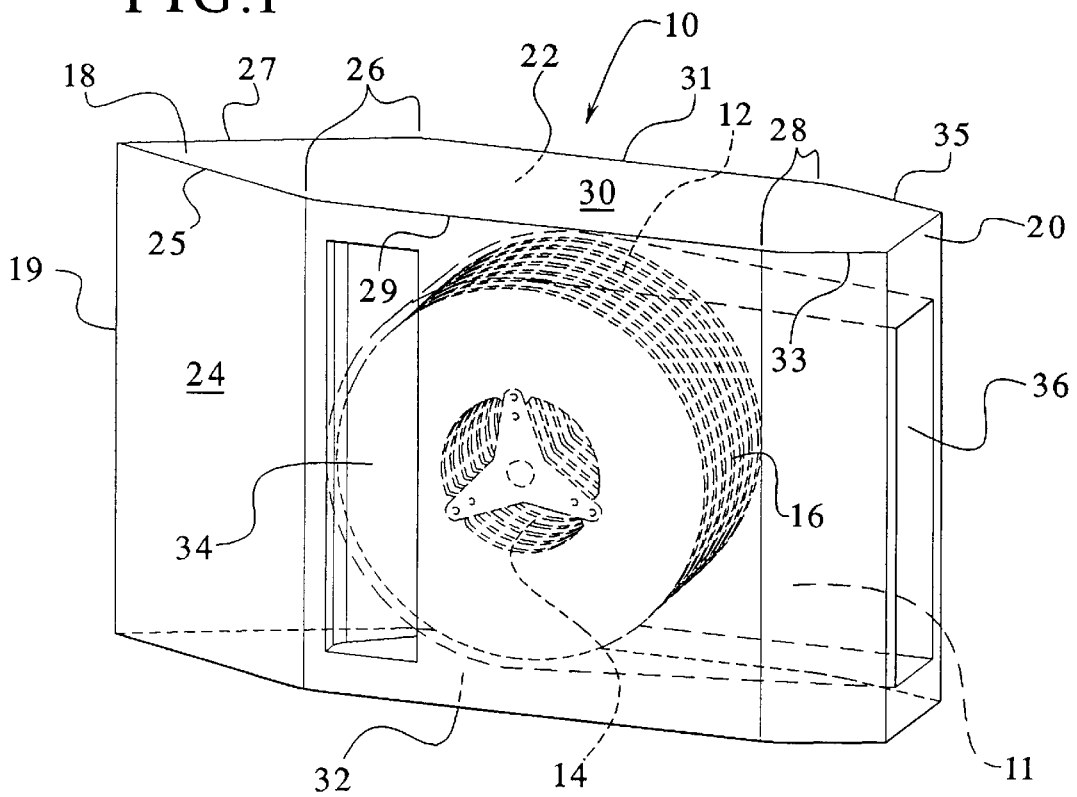
FIG. 1 illustrates a perspective view of an embodiment of a housing incorporating a plurality of disks in an embodiment of the present invention.

Referring now to the drawings wherein like numerals refer to like parts, FIG. 1 generally illustrates an embodiment of a housing 10 having a plurality of disks 12 incorporated therein. The plurality of disks 12 may be part of a propulsion system wherein the disks rotate at high speeds and a fluid such as air or water enters through an axial opening 14 in the center of the disks 12 and exits at a periphery 16 of the plurality of disks 12. The structure of the plurality of disks and use thereof is well known in the art and is generally shown and described in U.S. Pat. No. 1,061,206 to Tesla, the disclosure of which is incorporated herein by reference in its entirety. The specific shape and design of the disks, however, is not limited to that shown in FIG. 1.

The housing 10 has a wedge-shaped end 18 and a planar end 20 on opposite ends of the housing 10. The wedge-shaped end 18 provides for streamlined motion as the housing 10 moves through a fluid, such as air or water.

Two sides 22 and 24 are provided on opposite sides of the housing 10 and generally define the specific shape of the housing 10. The wedge-shaped end 18 has an edge 19. At the first wedge-shaped end 18, the two sides may have segments 25, 27 that form an acute angle at the edge 19 of the wedge-shaped end 18. The segments 25,27 may be disposed between the edge 19 and a point 26. The two sides 22,24 may have additional segments 29,31 that extend substantially parallel to each other from the point 26 to a second point 28. Further, segments 33,35 may be disposed between the second point 28 and the planar end 20. The segments 33,35 may be angled slightly towards each other at the second point 28. Top and bottom sides 30, 32 may be disposed substantially parallel to each other and are perpendicular to the sides 22 and 24. The edge 19, the sides 22, 24, the top side 30 and the bottom side 32 define the shape of the housing 10.

The housing 10, however, is not necessarily limited to the specific construction heretofore described. Other shapes are contemplated and will be apparent to those skilled in the art.

An inflow opening 34 may be provided along the side 24 to allow a fluid, for example, to enter the housing 10 and flow through the propulsion system 12. The opening 34 may be rectangularly shaped and provides a direct inlet to the axial opening 14 of the plurality of disks 12. However, the shape of the inflow opening 34 is not necessarily limited to the shape set forth stated above. Differently shaped openings are contemplated by the present invention and will be apparent to those skilled in the art. A second opening (not shown) may be provided in the side 22. The second opening may be identical to the first opening 34 but may be provided on an opposite side 22 of the housing 10 as compared to the first opening 34. The second opening may also provide a direct inlet to the axial opening 14 of the plurality of disks 12.

An outflow opening 36 may be provided in the planar end 20 to allow the fluid to exit the housing 10. The outflow opening 36 may be rectangularly shaped; however, other shapes are contemplated that provide a direct outlet from the housing 10.

Generally, as fluid enters the propulsion system 12, a layer of fluid molecules attaches to a disk surface forming a boundary layer. The boundary layer serves as a molecular buffer between the disk and the fluid contents. As the plurality of disks rotate at high speed, the boundary attracts and drags along other layers of molecules through centrifugal force. The dynamic force propels the fluid between the disks 12 and out the periphery 16 of the plurality of disks 12. The fluid is ejected forcefully from the housing 10 through the outflow opening 36.

In use, the housing 10 may be submerged in a fluid, such as water. A motor or an engine 56 (generically shown in FIGS. 2 and 3) provides a drive to spin the plurality of disks 12 at high speed. Spinning the disks 12 at a high speed forcefully ejects fluid contained between the disks 12 out the periphery of the disks 16 and subsequently out of the housing 10 through the outflow opening 36. More fluid may then be pulled through the intake opening 34 and subsequently forcefully ejected from the housing 10 through the opening 36. This provides a propulsion to the housing 10 if the housing 10 is free-standing within the fluid. The wedge-shaped end 18 provides a streamlined shape so that the housing 10 may move efficiently through the fluid. Any such rotor or engine may be utilized to impart rotary motion to the plurality of disks 12 to cause the disks 12 to spin at a high speed.

Preferably the edge 19, the sides 22,24, the top side 30, and the bottom side 32 form the outside walls of the interior compartment contained within the housing 10 that contains the plurality of disks. The housing 10, however, may have a cavity 11 formed therein. The cavity 11 may be shaped in such a manner so as to provide a compartment for the plurality of disks 12. The shape of the cavity 11 may provide a path for the forcefully ejected fluid to flow before exiting through the outflow opening 36.

Figure 2:
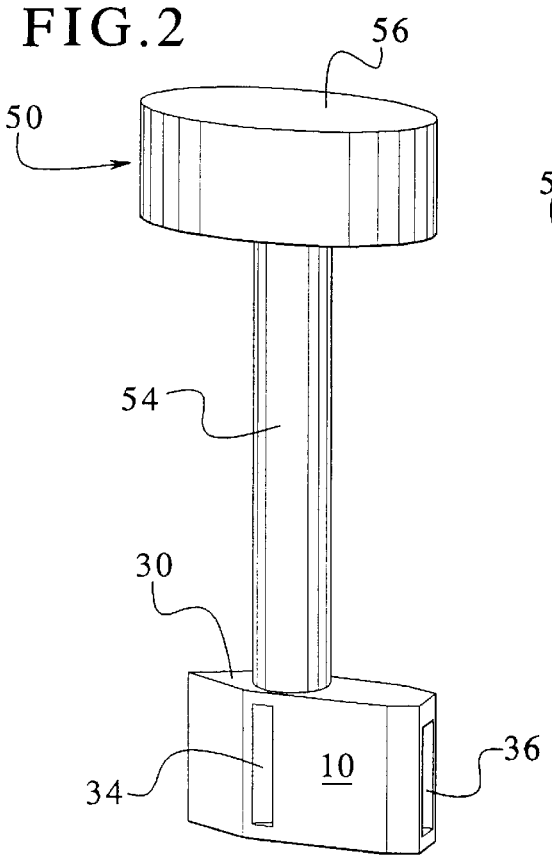
FIG. 2 illustrates a perspective view of an embodiment of a housing attached to a drive shaft and a motor.
Figure 3:
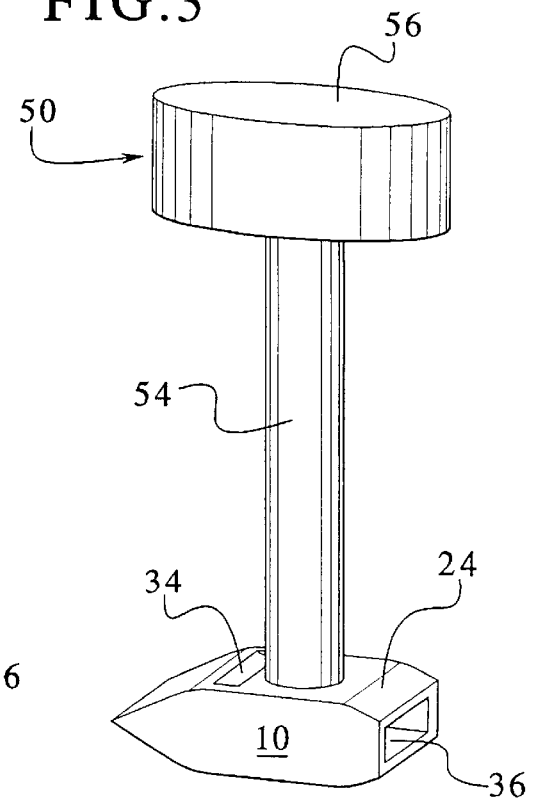
FIG. 3 illustrates a perspective view of an alternate embodiment of the housing, drive shaft and motor.

FIGS. 2 and 3 provide alternate embodiments 50 and 52, respectively, of the present invention wherein the housing 10 is attached to a shaft 54 and a motor or engine 56. The shaft 54 may be attached on the side 30 such that the axial opening 14 of the plurality of disks 12 are perpendicular to the drive shaft. Alternately, the housing 10 may be attached to the shaft 54 on the side 24 such that the axial opening 14 of the plurality of disks 12 may be disposed parallel to the shaft 54. Other like positions for the shaft 54 may be utilized in this invention and will be apparent to those skilled in the art.

In use, the housing 10 with the plurality of disks 12, the shaft 54 and the motor or engine 56 are provided attached to a craft (not shown), such as a boat or a submarine or other like vessel. Upon activation and rotation of the disks 12 within the housing 10, fluid may be drawn within the housing 10 through the intake opening 34 and forcefully ejected through the outflow opening 36. As the fluid is forcefully ejected from the housing 10, the boat or submarine may be propelled through the fluid.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. A system comprising:

a housing having a polygonal shape and having a first end, a planar second end and a planar first side substantially perpendicular to the second end wherein the first side is integrally formed between the first end and the second end and wherein the first side substantially meets the second end at a right angle and the first side substantially meets the first end at an obtuse angle and wherein the housing has an interior compartment defined between the first end and the second end, and further an interior compartment, wherein the interior compartment contains a plurality of disks, and further wherein the first end of the housing has a wedge shape;

a first intake opening on the first side of the housing, wherein the intake opening is located between the first end of the housing and the plurality of disks;

an outflow opening at the planar second end of the housing; and a propulsion system having a plurality of disks within the interior compartment of the housing.

2. The system of claim 1 wherein the intake opening is capable of directing a fluid directly into an axial opening of each of the plurality of disks.

3. The system of claim 1 further comprising:

a drive shaft on which each of the plurality of disks is rotatably attached.

4. The system of claim 3 further comprising:

a motor connected to the drive shaft capable of rdriving the propulsion system.

5. A method of using a disk propulsion system, the method comprising the steps of:

providing a housing having a polygonal shape and having a first end, a planar second end and a planar first side substantially perpendicular to the second end wherein the first side is integrally formed between the first end and the second end and wherein the first side substantially meets the second end at a right angle and the first side substantially meets the first end at an obtuse angle and wherein the housing has an interior compartment defined between the first end and the second end, and further an interior compartment wherein the first end of the housing has a wedge-shape and further wherein the housing has a first intake opening in the planar first side of the housing, and further wherein the housing has an outflow opening in the planar second end of the housing; and providing a propulsion system having a plurality of disks within the interior compartment of the housing.

6. The method of claim 5 further comprising the step of:

providing a motor attached to the plurality of disks.

7. The method of claim 5 further comprising the step of:

rotating the plurality of disks rapidly to provide a propulsive force to the housing in the fluid.

8. The method of claim 5 further comprising the step of:

providing a shaft between the rotor and the housing.

9. The method of claim 5 further comprising the step of:

pulling fluid through the intake opening; and allowing the fluid to flow through the housing.

10. The method of claim 5 further comprising the step of:

ejecting a fluid from the housing through the outflow opening.

* * * * *